US005319828A

United States Patent [19]

Waldhauser et al.

[11] Patent Number: 5,319,828

[45] Date of Patent: Jun. 14, 1994

[54] LOW PROFILE SCRUBBER

[75] Inventors: Steven J. A. Waldhauser, Niagara Falls; Christopher K. Pearce, Ransomville; Ross Rumfola, Pendleton, all of N.Y.

[73] Assignee: Tennant Company, Minneapolis, Minn.

[21] Appl. No.: 971,404

[22] Filed: Nov. 4, 1992

[51] Int. Cl.[5] ..... A47L 7/00; A47L 9/04; A47L 11/18

[52] U.S. Cl. ..... 15/320; 15/322; 15/353; 15/354; 15/359; 15/383

[58] Field of Search ..... 15/320-321, 15/353, 354, 359, 372, 322, 383

[56] References Cited

U.S. PATENT DOCUMENTS

| | | | |
|---|---|---|---|
| 1,328,339 | 1/1920 | Rowe | 15/320 |
| 1,801,135 | 4/1931 | Blogg . | |
| 1,966,582 | 7/1934 | Davis | 15/353 |
| 1,975,380 | 10/1934 | Streich . | |
| 2,524,928 | 10/1950 | Platz . | |
| 2,635,277 | 4/1953 | Belknap | 15/353 |
| 3,392,418 | 7/1968 | Schowalter | 15/320 |
| 4,014,067 | 3/1977 | Bates | 15/320 |
| 4,055,405 | 10/1977 | Thun-Hohenstein | 15/353 |
| 4,062,085 | 12/1977 | Duncan | 15/353 |
| 4,096,601 | 6/1978 | Knestele . | |
| 4,136,420 | 1/1979 | Cyphert | 15/321 |
| 4,167,798 | 9/1979 | Klugl | 15/321 |
| 4,369,544 | 1/1983 | Parisi | 15/320 |
| 4,649,594 | 3/1987 | Grave | 15/322 |
| 4,696,074 | 9/1987 | Cavalli | 15/321 |
| 4,817,233 | 4/1989 | Waldhauser | 15/320 |
| 4,819,676 | 4/1989 | Blehert | 15/353 |
| 5,042,109 | 8/1991 | Stephens | 15/354 |
| 5,093,955 | 3/1992 | Blehert | 15/353 |
| 5,155,876 | 10/1992 | Whitaker | 15/353 |

FOREIGN PATENT DOCUMENTS

| | | | |
|---|---|---|---|
| 3115038 | 11/1982 | Fed. Rep. of Germany | 15/320 |
| 10140 | 1/1911 | United Kingdom | 15/372 |

*Primary Examiner*—Philip R. Coe
*Assistant Examiner*—Terrence R. Till
*Attorney, Agent, or Firm*—Dorn, McEachran, Jambor & Keating

[57] ABSTRACT

A floor scrubbing machine for tile and other hard surface floors has a low enough profile height that it can be operated bodily under furniture or equipment such as, for example, seats in fast food stores. This floor scrubber has three principle functioning components, comprising a tank for cleaning solution and means to apply that solution to the floor, a powered scrub brush to agitate the solution on the floor, and a vacuum pickup squeegee system which dries the floor after scrubbing by removing spent solution from the floor to an on board tank. Floor scrubbers are known which comprise the three above elements, but are too tall to operate under the seats of fast food stores, except with a remote wand attachment which is cumbersome and slow. Other floor scrubbers are known which are low enough to operate bodily in such places but lack a vacuum pickup squeegee system for drying the floor, and leave a hard surface floor unacceptably wet, or require following operations to dry it. The present invention overcomes the shortcomings of these prior art floor scrubbers.

6 Claims, 5 Drawing Sheets

LOW PROFILE SCRUBBER

BACKGROUND

The rise of fast food chains has been a phenomenon of our times. All over the country one finds these stores that sell hamburgers, french fries, chicken, soft drinks and such for taking out or eating on the premises. As with any food service business, zealous attention to cleanliness is essential in these establishments, and ease of cleaning is given careful thought in the design of the stores. This architectural foresight often shows in the floors, which are usually surfaced with ceramic tile, and in the seats and tables provided in the dining areas, which are commonly built with cantilevered supports so that most of the floor area under them is unobstructed. These features, of course, are intended to make it easier to clean the floor, which gets all kinds of food dropped on it, as well as mud, snow etc. tracked in from outdoors.

However, these under seat areas do not have a very high floor clearance. A survey of a group of fast food stores found that almost two-thirds of them had seats with a largely unobstructed area under them which had a vertical clearance from the floor to the undersides of the seats that was between eleven and fifteen inches. It is not easy to clean the floor under these seats because scrubbing machines built low enough to get under them and do a good fast job of cleaning and drying the floor are not available. Various types of floor cleaning machines are used, but none of them is completely satisfactory.

So-called automatic scrubbers are available which are comprised of a tank for cleaning solution and means to apply that solution to the floor, one or more powered rotating scrub brushes to agitate it on the floor and a vacuum pickup squeegee system to dry the floor after scrubbing by removing the solution from the floor to an on board tank. These do good fast cleaning, and their vacuum pickup squeegees leave a hard surfaced floor barely damp. It will be dry enough to walk on safely and will be completely dry in a few minutes. However, they are intended for cleaning aisles and open areas, and they are too tall to get under equipment and furniture that have only eleven to fifteen inches of floor clearance. This is because these scrubbers have relatively large tanks, they require a substantial plenum space above the water level in their recovery tanks to assist in controlling foam, and commonly their vacuum fans are placed above their recovery tanks. The best that can be done when scrubbing the floor of a fast food store with these machines is to park them in the aisle and use a wand attachment with a long vacuum hose to clean under the seats. The wand is cumbersome and slow to use. Typical examples of this type of floor scrubber are the Drynamic~ 170 floor cleaning system made by Tennant Trend of Niagara Falls, N.Y., and the Convertamatic~ high-speed floor maintenance machines made by Advance Floor Machine Company of Spring Park, Minn.

Other floor cleaning machines are available which have small bodies with a low enough profile height to be pushed bodily under equipment and furniture having a floor clearance of even less than eleven inches. They all have one or two powered rotating scrub brushes and do a good job of cleaning the floor. However, there isn't enough room in one of their small bodies for a system to dry the floor after scrubbing, which necessitates following after them with a wet vac or a mop and a wringer bucket. This substantially increases the time needed to clean and dry a floor. An example is the Windsor Grouthog~ made by Windsor Industries Inc. of Englewood, Colo.

The need for water pickup is recognized in some of these low profile scrubbers, but there isn't room enough in their bodies for a vacuum pickup squeegee system so they are built with other means to pick up used scrub water. Thus the Rotowash machines distributed by R. E. Whittaker Co. of New Castle, Pa., have two rotating cylindrical scrub brushes which fling water onto a slowly rotating drum between them. This water is carried up and over the top of the drum where a scraper wipes it off and directs it into a recovery tank. Experience has shown, however, that such water pickup systems do not dry a floor anywhere nearly as well as a vacuum pickup squeegee system does. Nothing has been found that will dry a hard surface floor as well as a vacuum pickup squeegee system, and to our knowledge the prior art has not produced a low profile scrubber with one.

Many fast food stores resort to a mop and a wringer bucket, and the results of using them leave much to be desired. Mopping is slow work, tends to slop dirty water on adjoining walls, and will leave a wet or still dirty floor if carelessly done.

Fast food stores are not alone in facing this problem. Other types of business establishments have furniture and equipment with a vertical clearance from the floor up to the lowest part of the equipment that is similar to the clearance under seats and tables in fast food stores. Examples might be counters and ovens in institutional kitchens such as in hospitals, nursing homes and schools, also work benches, storage racks, or machine tools in industrial plants. The present invention could be useful in such places, but for simplicity we will limit our discussion to fast food stores.

It is apparent that there is a long felt need which has been unfilled at least as long as there has been a fast food industry for a hard floor cleaning machine having the elements of an automatic scrubber (i.e. solution storage and distribution, powered scrubbing brush, and vacuum pickup squeegee with storage of dirty water) but capable of being pushed bodily under seats and tables (or other equipment having similar clearance above a floor) and scrubbing there as well as present automatic scrubbers do in aisles or other unobstructed areas.

SUMMARY OF THE INVENTION

The primary object of the invention is to provide a floor scrubber for tile and other hard surfaced floors, the body of which has a low enough profile height that it can be pushed under the seats and tables found in most fast food stores, or under other equipment having a similar clearance above the floor, which may be taken as eleven to fifteen inches, said floor scrubber comprising a tank for cleaning solution and means to apply that solution to the floor being scrubbed, a powered scrub brush to agitate the solution on the floor, and a vacuum pickup squeegee system to dry the floor by removing spent solution from the floor to an on board tank.

Another object is to use only one tank or bucket in the scrubber to hold clean scrubbing solution and also to receive and hold dirty solution picked up by the vacuum squeegee, thereby eliminating a separate tank for receiving soiled solution from the squeegees and thus contributing to the low profile height of the scrubber body by reducing the tank volume in said body, as well as providing extended run time by recycling at least some of the scrubbing solution.

Another object is to provide a tank in the form of a bucket within the scrubber body for holding a prescribed amount of scrubbing solution, and to make this bucket relatively shallow in relation to its length and width to reduce its height.

Another object is to provide said tank in the form of a removable bucket for holding cleaning solution within the body of the scrubber, so that said bucket can be lifted out of the body when it is desired to empty it, thereby eliminating any need for providing a drain with attendant vertical dimensions in the bottom of the solution tank or bucket.

Another object is to provide a minimum height plenum above the removable bucket, said minimum height contributing to the low profile height of the scrubber body.

Another object is to provide a novel system for minimizing the generation of foam in said plenum, said novel system being functional in spite of the minimum height of the plenum.

Another object is to provide a duct fluidly connecting said plenum with an exhaust blower for partially evacuating air from above the bucket.

Another object is to locate said exhaust blower essentially on a level with and alongside of the bucket rather than above the bucket to reduce the height of the scrubber body.

Another object is to dispose the scrubber elements within the scrubber body in a generally horizontal relationship to each other rather than a vertical arrangement.

Another object is to provide a handle attached to the body of the scrubber by the use of which a walking operator can push or pull, steer and control the scrubber, said handle being pivotally attached to said body so that on occasion said handle may be lowered to not interfere with pushing said body under seats and tables or other equipment.

Another object is to provide a hand control associated with said handle by the use of which the operator from a position behind the machine or to either side of it can start or stop the scrub brush and the flow of cleaning solution, so that these scrubbing functions can be easily controlled at all times, regardless of where the operator may stand while pushing the scrubber body under seats and tables or other equipment.

Another object is to provide a floor scrubber having a pickup squeegee in front of the powered scrub brush and another one behind the brush so that the scrubber can scrub and pick up cleaning solution while moving forward or backward.

Another object is to locate a scrub head comprising the scrub brush and a brush cover comprising the two pickup squeegees and a solution distributing means at the front of the scrubber body so that an operator of the machine can push it up to a wall and the machine will scrub and dry the floor right up to the wall.

DETAILED DESCRIPTION OF THE DRAWINGS

Figure 1A:
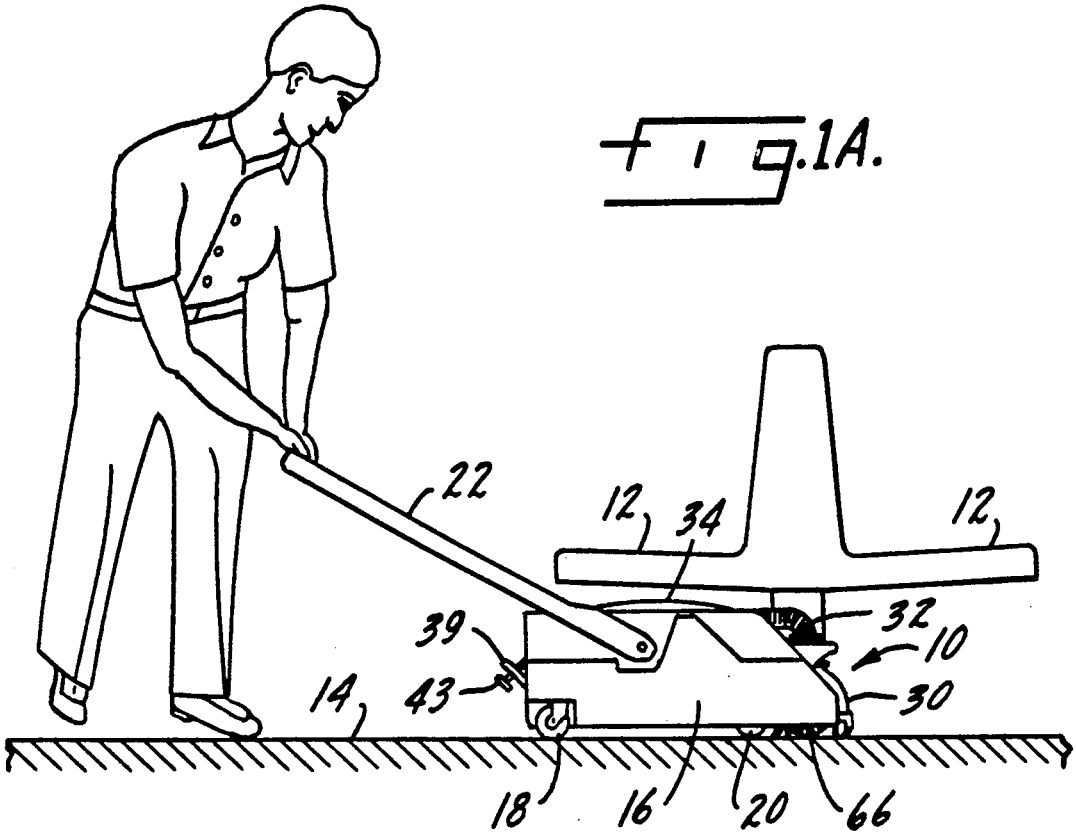
FIG. 1A shows the floor scrubber of the present invention being used to clean under a seat in a fast food store.
Figure 1B:
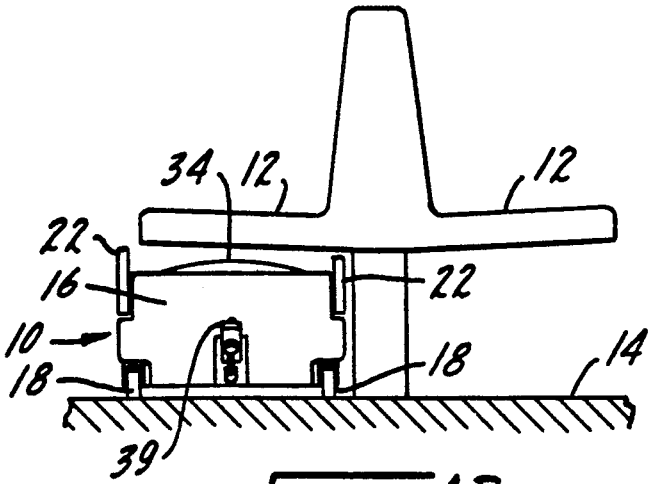
FIG. 1B shows a rear view of the floor scrubber of the present invention after being pushed under a seat in a fast food store at 90 degrees to the direction shown in FIG. 1A.

Referring now to FIG. 1A, there is shown a low profile floor scrubbing machine 10 in use scrubbing the floor of a fast food store. In particular, the work is being done under two seats 12 such as are typically found in the dining booths of such establishments. A study has found that in the majority of such seats there is vertical clearance from the floor to the undersides of the seats ranging from eleven to fifteen inches, and scrubber 10 has a low enough profile height to operate in this head room. The floor 14 will have a hard surface, typically grouted ceramic tile or quarry tile, and the scrubber 10 is particularly adapted to operate on this type of floor by virtue of its cylindrical brush and vacuum pickup squeegee system. FIG. 1B shows another view of scrubber 10 operating under seats 12. This time the scrubber has been pushed under the seats in a direction relative to the seats which is 90 degrees from the direction it is being pushed in FIG. 1A.

Figure 2:
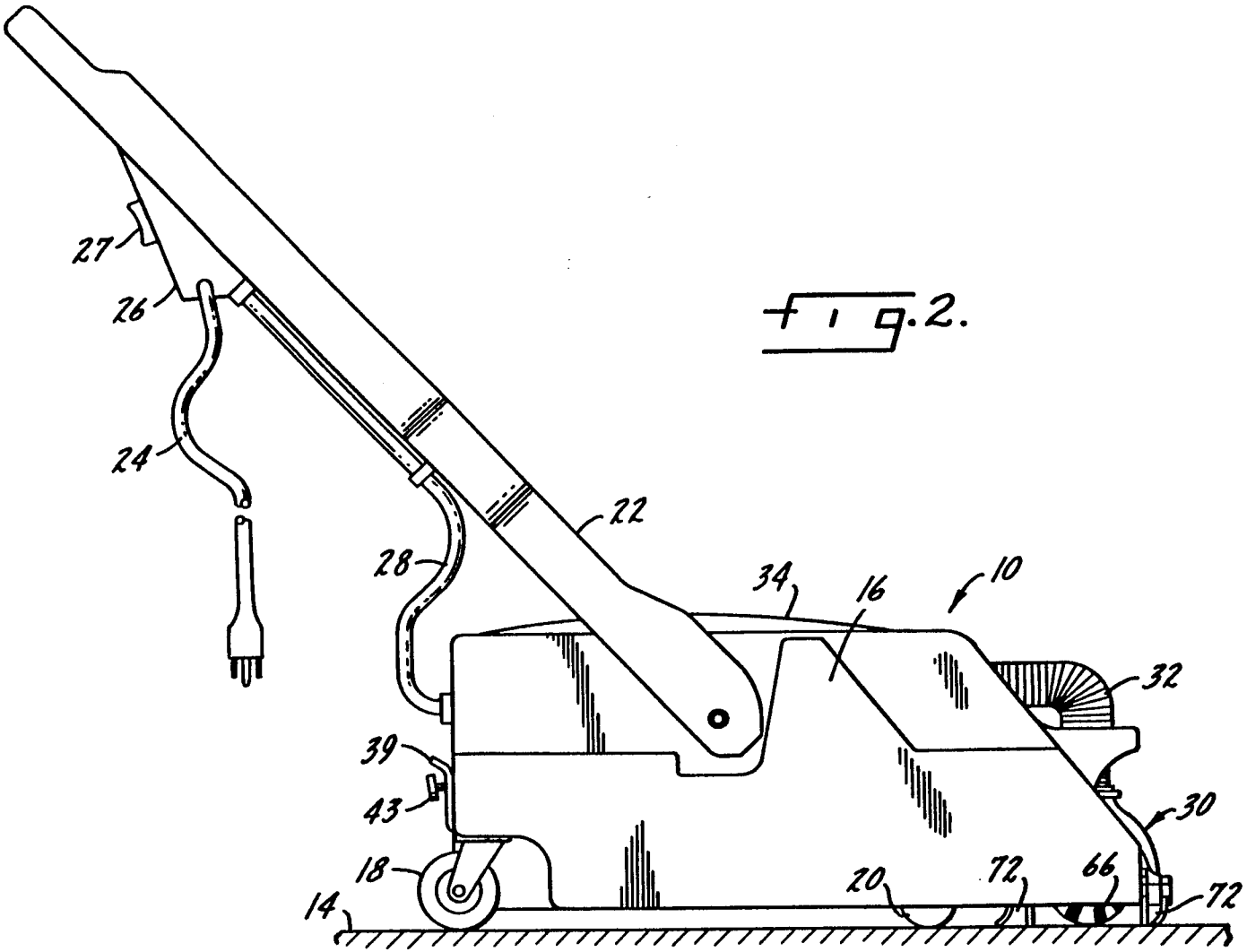
FIG. 2 shows a side view of the scrubber of the present invention.

FIG. 2 shows a right side view of the scrubber 10. A molded plastic housing 16 is the main structural part; other drawings show details of its construction. A scrub head indicated generally at 30 is mounted on the front of the machine, and a vacuum suction hose 32 runs from scrub head 30 to housing 16. A molded plastic cover 34 on the top of the housing 16 gives access to internal components and cooperates with other parts in controlling water and air flow, as will be discussed later. The weight of the scrubber is carried on two rear caster wheels 18 and one front wheel 20.

Figure 4:
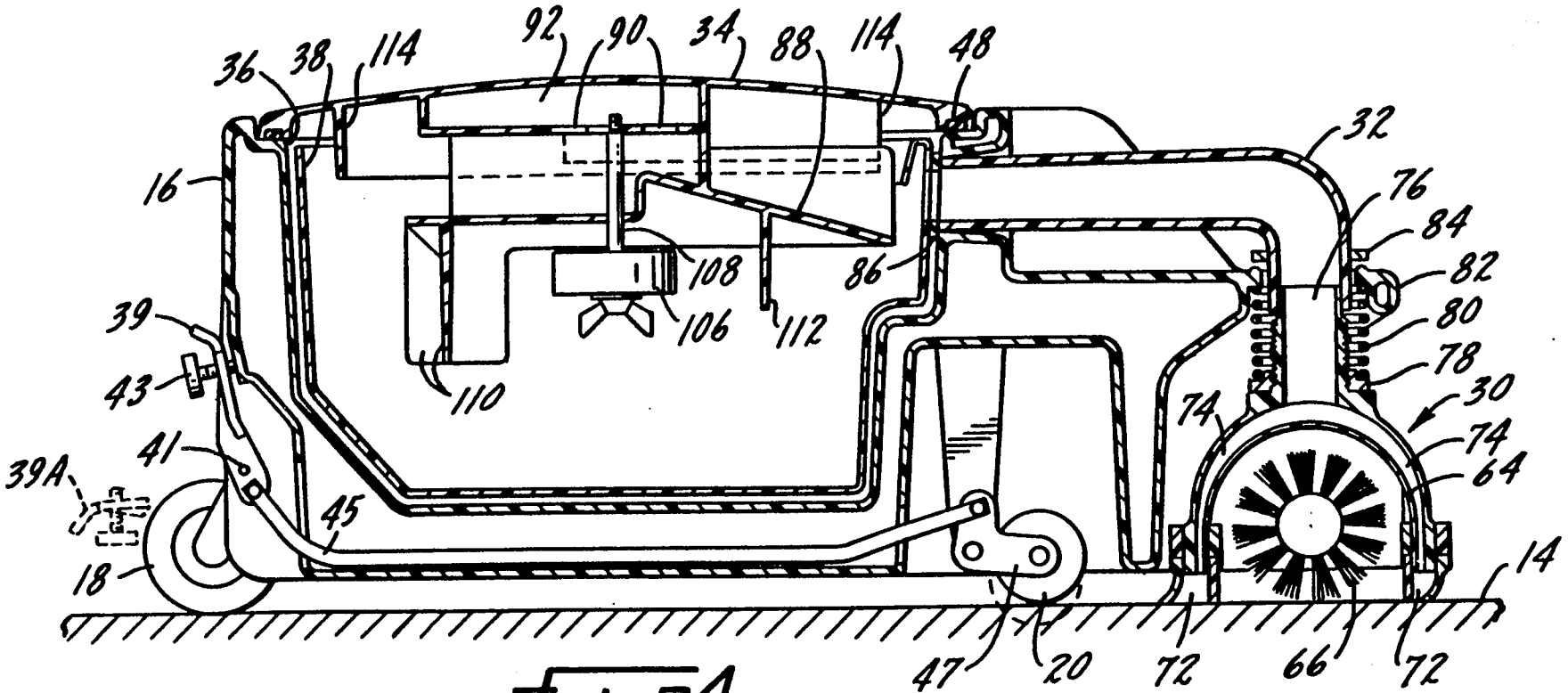
FIG. 4 shows a longitudinal section through the scrubber taken on line 4—4 of FIG. 3.

Referring to FIG. 4, it will be seen how front wheel 20 can be set at a height to support the scrub brush 66 at its best working height, and how this may be adjusted as the brush wears. It will also be seen how a transport height is provided where the brush and squeegees 72 are clear of the floor.

Toe pedal 39 is pivotally attached to housing 16 at pivot point 41. Hand screw 43 is threaded into pedal 39 and bears against housing 16 to adjustably position pedal 39. Rod 45 is pivotally attached to pedal 39 and runs forward through a tunnel in housing 16 to a pivotal attachment with bell crank 47, which supports front wheel 20. The working height of brush 66 is maintained by wheel 20, and can be adjusted by turning hand screw 43 in or out.

Toe pedal 39 can be pushed down to a position shown as 39A, which it holds until pushed up because rod 45 is then in an over center position. This action causes rod 45 to push forward on bell crank 47, which lowers wheel 20 to a transport position shown in dotted outline where the brush 66 and the squeegees 72 will be lifted clear of the floor.

As seen in FIG. 2, a molded plastic handle 22 is pivotally attached to the housing 16, and can pivot from a vertical position for storage to a horizontal position, which may be used when the scrubber is to be pushed far under a piece of overhanging furniture or equipment.

The machine draws its power from a wall outlet through power cord 24. A control module 26 on handle 22 provides switches to control the scrubber functions, and the switched signals travel to the scrubber body via power cable 28. A thumb switch 27 which controls the vacuum blower 42 is shown on the control module 26, and other switches as needed may also be there.

Figure 3:
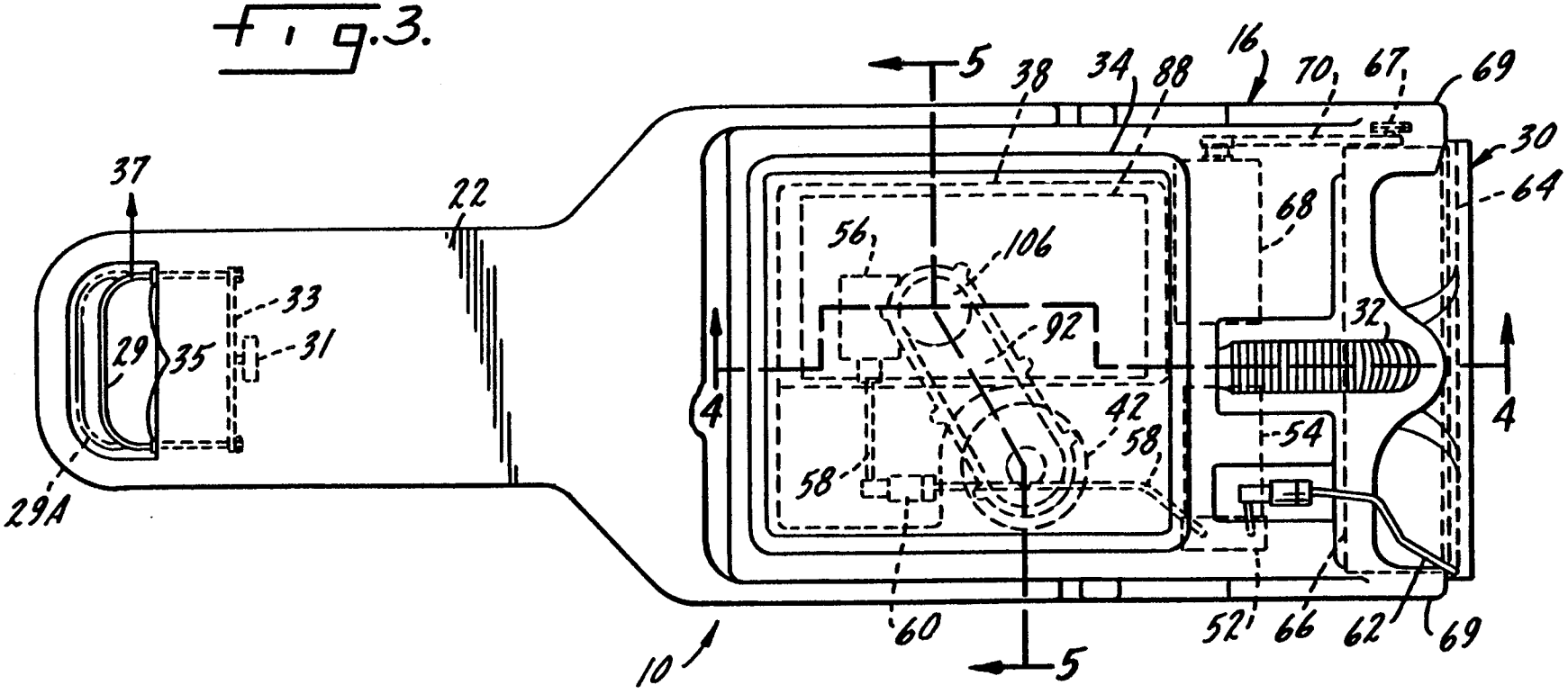
FIG. 3 shows a top view of the scrubber with its handle laid down flat and with major internal components indicated by dotted outlines.

Referring to FIG. 3, there is shown a hand control 29. In its position shown in solid lines it is spring loaded (spring not shown) so that bar 33 bears against normally closed snap action switch 31, thus holding this switch open. Switch 31 controls current to motor 68 which drives scrub brush 66 and in normal scrubbing also controls current to motor 54 which drives solution pump 52. Thus when hand control 29 is positioned as shown in solid lines the scrub brush will not rotate and in normal scrubbing pump 52 will not run, so no cleaning solution will be delivered to the floor.

It is easy for a machine operator to reach hand control 29 with his or her fingers and hold it in the position shown in dotted outline 29A. This will move bar 33 away from snap action switch 31, which assumes its normally closed position. Then scrub brush 66 will rotate and in normal scrubbing pump 52 will deliver cleaning solution to the floor.

Hand control 29 has two shoulders 35 formed on it. These make it possible to operate switch 31 by pulling control 29 sidewise as well as straight. Thus if an operator pulls control 29 sideways as indicated by arrow 37, the control will pivot around the shoulder 35 nearest arrow 37. This will move the central part of bar 33 away from switch 31, thus effectively closing the switch. This makes it possible for the operator to control the scrub brush and solution flow whether he or she is standing behind the machine or to one side of it. This can be handy when maneuvering the scrubber into some restricted spaces.

Figure 5:
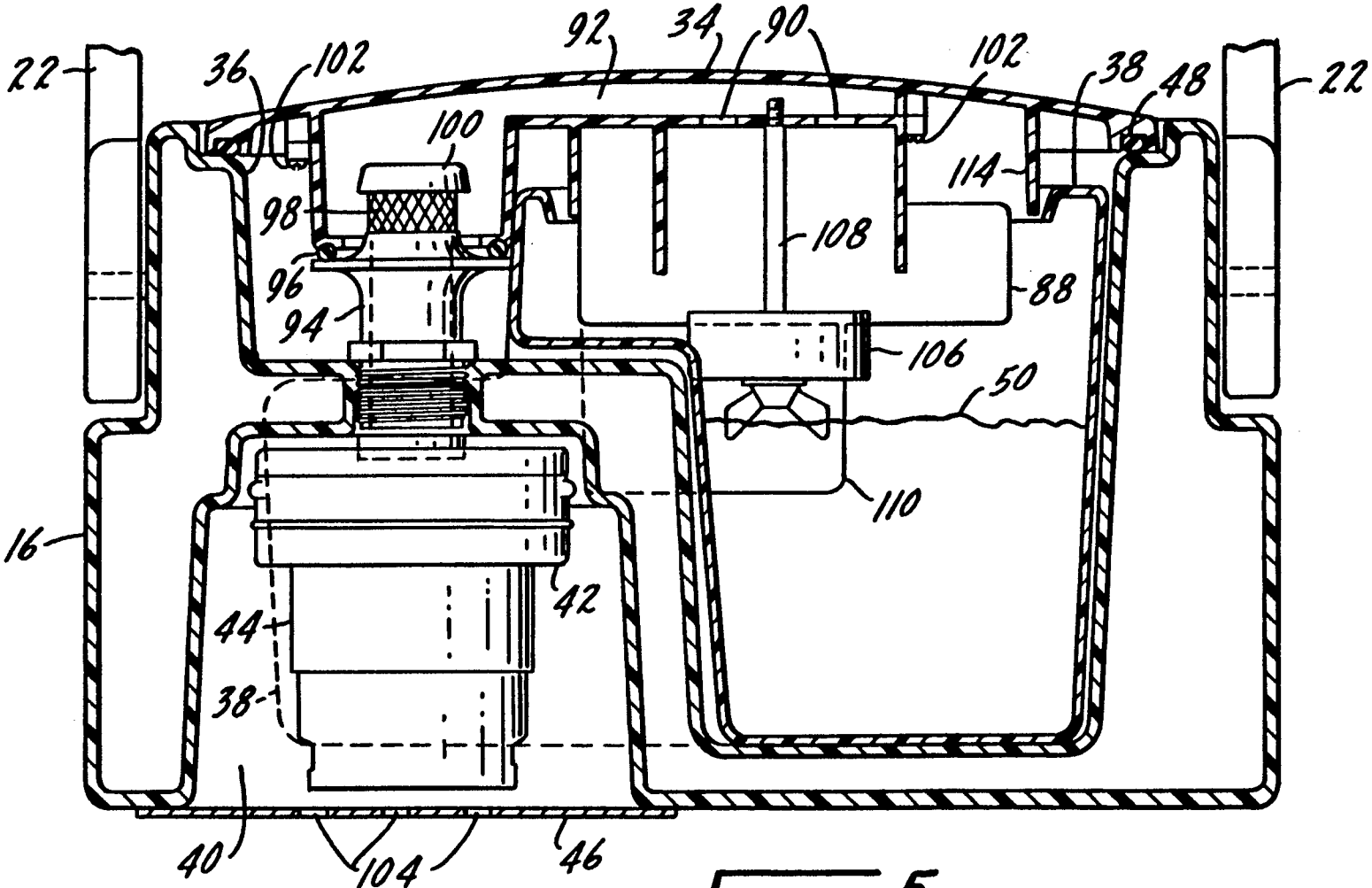
FIG. 5 shows a sectional view taken on line 5—5 of FIG. 3.

Housing 16 has a double wall, which can be seen in FIGS. 4 and 5, and provides the surrounding walls and part of the bottom for the scrubber body. It also provides a large upward opening cavity 36 which may be seen in FIGS. 4 and 5, and a downwardly opening cavity 40 that may be seen in FIG. 5. Upward opening cavity 36 primarily houses a removable tank or bucket 38 to hold cleaning solution, while downward opening cavity 40 houses a vacuum blower 42 and its motor 44 and other parts which will be discussed later. A sheet steel plate 46 covers the bottom of cavity 40.

Cover 34 covers the upward opening cavity 36. A gasket 48 seals it to the housing. Bucket 38 has a normal water level 50 and has a folding handle (not shown) by means of which it can be lifted out of the scrubber for emptying when cover 34 is removed. This avoids providing it with a bottom drain, which would add t its vertical dimensions and thus to the height of the scrubber. It will be noted that bucket 38 is also rather shallow relative to its width and length, further reducing its height.

A pump 52 and its drive motor 54 are shown in dotted outline in FIG. 3. In the bottom of bucket 38 there is a screened intake 56 connected to tube 58 by means of which pump 52 draws cleaning solution from the bucket. A quick release coupling 60 in line 58 is easily disconnected when it is desired to remove the bucket. Pump 52 delivers cleaning solution through flexible tubing 62 to a perforated stainless steel tube or manifold 64 in the scrub head 30, from which the solution is sprayed on the floor.

Scrub brush 66 is carried by two bearings 67 (only one shown) mounted in two forward arms 69 which are part of housing 16. It is rotated by a motor 68 and a drive belt 70. It agitates the cleaning solution on the floor, scrubbing and cleaning it thoroughly.

In front of and behind brush 66 are pickup squeegees 72, best seen in FIG. 4. Air passages 74 in scrub head 30 connect the squeegees to a common outlet 76 so that vacuum is applied to both squeegees. They have an automatic valving action such that when the scrubber is pushed forward the front squeegee valves itself shut and the entire vacuum is applied to the rear squeegee for maximum water pickup and floor drying behind the brush. When the scrubber is pulled backward the rear squeegee closes and the front one opens, so that the squeegee that is behind the brush in the instantaneous direction of travel will always be open and the one instantaneously ahead of the brush will always be closed. Thus a strong vacuum squeegee wiping and drying action on the hard surface floor 14 takes place whether the scrubber is being pushed or pulled. This squeegee construction and action is fully discussed in U.S. Pat. No. 4,817,233, U.S. Pat. No. Re. No. 33,926, so will not be further described here.

It should be further noted, however, that by placing the scrub brush and squeegees at the extreme front of the scrubber it is possible to scrub right up to a baseboard, which is a useful characteristic when the job to be done is to scrub the floor under restaurant seats or the like.

Air outlet 76 is round, and threaded on its outside. A nut 78 can be run by hand up and down these threads. A compression spring 80 surrounds outlet 76 and bears against an extended lip 82 of housing 16, so the spring 80 can be more or less compressed by turning nut 78. This will adjust the down pressure on the squeegees for optimum wiping and drying. Flexible hose 32 is connected at one end to outlet 76 and at the other end is push fitted into a hole in the forward wall of housing 16. A rigid plastic ring 84 is a tight fit on hose 32. When the front end of the scrubber is lifted for transport, spring 80 pushes the squeegee assembly down until ring 84 strikes the top side of housing extension 82. Then the squeegees can go no lower, and will be lifted off of the floor for transport. A soft doughnut shaped rubber seal 86 is cemented to the housing 16 around the hole where suction hose 32 is inserted. Bucket 38 presses against seal 86 so that water entrained with the air coming through suction hose 32 will be directed into the bucket, and will not run down outside of it.

The stream of air and entrained water coming into bucket 38 from suction hose 32 impinges on the upper sloping surface of diffuser 88. Here the water spreads out in a sheet across the surface of the diffuser while the air expands into the space above the water level 50 and below the cover 34. In the process both water and air lose velocity. The water runs down the slope of the diffuser and drops into the bucket. Vacuum blower 42 pulls the air through air passages 90 into air duct 92. This leads to a structure 94 at the inlet to vacuum blower 42. A gasket 96 seals the duct to the inlet structure. The mouth of the inlet structure is protected with a screen 98, which in turn is protected with a cap 100. The lower wall of air duct 92 is molded integrally with diffuser 88, and the entire part is attached to cover 34 with screws around the air duct, two of which are shown as 102 in FIG. 5. Suction blower 42 draws in air through inlet structure 94 and exhausts it out around the periphery of its casing into downward opening cavity 40. From there the air passes to atmosphere through several holes 104 in bottom cover plate 46.

A light weight float 106 can slide up and down on the shank of wing bolt 108. If for some reason the water level 50 in bucket 38 should get abnormally high the float would rise and block off air flow through air passages 90, thus stopping the air flow and protecting suction blower 42, and also stopping the flow of air and water into the bucket 38.

There are several baffle plates 110 and 112 which depend from diffuser 88. Also there is a deflector 114 which depends from cover 34 and follows around inside the entire perimeter of bucket 38. These baffles and deflectors are to control sloshing of water in the bucket, which otherwise would become quite pronounced and would generate foam as the scrubber is alternately pushed and pulled back and forth during operation.

When water that contains detergent is entrained in air and moved at high speed as happens in vacuum pickup squeegee systems, the airflow is turbulent and tends to generate foam. On occasion foam can accumulate in the top of the recovery tank in a scrubber until it fills the duct to the suction blower. Then it goes through the blower and is thrown out to atmosphere, making a glorious mess and possibly damaging the blower. Scrubbers using vacuum pickup squeegees all cope with this problem. Ducts with gradually expanding cross sectional area are sometimes used to slow the flow velocity; so are scroll wrap impingement plates. Universally a substantial plenum space is provided above the water level in the recovery tank to accumulate foam and give it time to settle. The sloping diffuser plate 88 used in the present invention is innovative, and is thought to be unique. It serves to slow the turbulent airflow and spread the cleaning solution over the diffuser surface so it forms a laminar flow, thus minimizing foam. This is done with a much lower plenum volume above the water level than used in other scrubbers, which is a major factor in the low profile of the machine.

It will be noted that the same bucket is used to store clean solution before pumping it to the floor and to receive soiled solution picked up from the floor after scrubbing. The solution in the bucket thus becomes progressively dirtier. However, up to a point dirty water works as well as clean water for scrubbing. When it becomes too dirty then the bucket must be emptied and refilled, but before then the solution in the bucket will have been recycled several times, making in effect a single tank recycling system. For a given run time, then, a smaller tank can be used than if there were no recycling, and this smaller tank in turn contributes to reducing the profile height of the machine.

In summary, the present invention provides a low profile scrubber for hard surface floors, said scrubber having a tank for cleaning solution and means for applying that solution to the floor, a powered brush to agitate solution on the floor, and a vacuum pickup squeegee system to remove soiled solution from the floor to an on board tank, leaving the hard surface floor dry enough that it can dry completely in a few minutes. Novelty lies in the fact that a scrubber of this type has a low enough profile height that it can operate bodily under overhead structures such as, for example, the majority of seats found in fast food stores.

In the preferred embodiment as described, the above useful end has been accomplished by a new combination of a number of known elements and one or more new elements. A single tank is used for recycling cleaning solution, and that tank is relatively shallow with respect to its length and width. This tank is removable for emptying, so it has no bottom drain. The necessary suction blower is set alongside the tank, not on top of it, with modified ductwork to conduct air from the tank to the blower. Other elements inside the scrubber, e.g. the brush motor and the solution pump, are disposed horizontally, not vertically. The handle is pivotally attached in a manner that permits lowering it to horizontal when necessary to push the machine far under an overhanging structure. And significantly, a novel diffuser system, aided by several anti-slosh baffles, is employed to control foam in a plenum having considerably less height than is commonly provided in scrubbers.

The above elements were combined in the preferred embodiment to achieve the objects of the invention. However, there are always many possible solutions to any problem in machine design, and it is possible that the objects of the invention could be achieved by a different combination of the same or other elements. It is therefore desired that the invention be unrestricted except by the appended claims.

The embodiments of the invention in which an exclusive property or privilege is claimed are defined as follows:

1. A low profile floor scrubber that carries a supply of cleaning solution applies it to a floor being scrubbed, agitates it on the floor with a powered brush, then picks up the soiled solution with a vacuum squeegee and stores it on board, said low profile floor scrubber comprising in combination a housing, a removable cover over at least part of the housing, wheels rotatably attached to said housing for supporting and moving the floor scrubber, a handle attached to the housing, a rotatable scrub brush for scrubbing a floor, said scrub brush and a scrub head being attached to said housing, said scrub head covering said brush and having at least one pickup squeegee attached to it and in contact with a floor being scrubbed, a brush drive motor within the housing and drive means connected to said motor for rotating said scrub brush, a tank within said housing for holding cleaning solution to be applied to a floor being scrubbed and for receiving and holding soiled solution recovered from the floor, said tank being removable when said cover is removed for emptying the solution therein, said tank being relatively shallow with respect to its length and width, a plurality of baffles located to be at least partially immersed in cleaning solution in the tank, a plenum chamber above said tank, a sloping diffuser plate within said plenum chamber, a suction blower and a motor to drive it located within the housing, first passage means connecting the plenum chamber to the inlet of the suction blower, second passage means connecting said at least one pickup squeegee to the plenum chamber, said second passage means having an opening into the plenum chamber such that flow from the opening into the plenum chamber impinges at an angle upon the upper surface of the diffuser plate to create a laminar flow thereon, said diffuser plate sloping downward toward said opening, a pump with drive motor and connected tubing within the housing to pump cleaning solution from the tank to a distribution means attached to the scrub head, said distribution means delivering solution to the floor being scrubbed, said scrub head, brush drive motor, solution/recovery tank, suction blower and solution pump with motor all being disposed generally horizontally relative to one another.

2. The scrubber of claim 1 further characterized in that said first passage means is formed in said cover.

3. The scrubber of claim 1 further characterized in that said baffles extend from said removable cover.

4. The scrubber of claim 1 in which the handle is pivotally attached to the housing.

5. The floor scrubber of claim 4 in which a D-shaped hand control on the handle includes two shoulders such that the control may be operated from behind the scrubber handle or from either side of it.

6. The scrubber of claim 1 further characterized by and including a quick disconnect coupling between said container and pump to permit removal of said solution container.

* * * * *